United States Patent [19]

Engl et al.

[11] 4,042,006

[45] Aug. 16, 1977

[54] PYROLYTIC PROCESS FOR PRODUCING A BAND-SHAPED METAL LAYER ON A SUBSTRATE

[75] Inventors: Alfred Engl; Guenther Heim, both of Regensburg, Germany

[73] Assignee: Siemens Aktiengesellschaft, Berlin & Munich, Germany

[21] Appl. No.: 624,711

[22] Filed: Oct. 22, 1975

Related U.S. Application Data

[63] Continuation-in-part of Ser. No. 429,100, Dec. 28, 1973, abandoned.

[30] Foreign Application Priority Data

Jan. 5, 1973 Germany ..... 2300481

[51] Int. Cl.[2] ..... B22D 23/00; B05D 3/02; B05D 3/06

[52] U.S. Cl. ..... 164/46; 164/131; 164/132; 427/43; 427/53; 427/102; 427/103; 427/250; 427/252; 427/255; 427/261; 427/265; 427/266; 427/287; 427/107; 427/237; 338/300; 338/309

[58] Field of Search ..... 427/43, 53, 107, 231, 427/237, 255, 259, 287, 252, 102, 103, 261, 250, 265, 266; 164/46, 131, 132; 338/300, 309

[56] References Cited

U.S. PATENT DOCUMENTS

| | | | |
|---|---|---|---|
| 2,178,419 | 10/1939 | Clark | 427/231 |
| 2,891,880 | 6/1959 | Nakken | 427/102 |
| 3,061,464 | 10/1962 | Norman | 427/252 |
| 3,061,465 | 10/1962 | Norman | 427/252 |
| 3,256,109 | 6/1966 | Berger | 427/53 |
| 3,293,587 | 12/1966 | Robinson | 338/300 |
| 3,419,487 | 12/1968 | Robbins | 204/164 |
| 3,516,855 | 6/1970 | Goll | 427/43 |
| 3,531,318 | 9/1970 | Booth | 427/231 |
| 3,560,258 | 2/1971 | Brisbane | 427/53 |
| 3,562,009 | 2/1971 | Cranston | 427/43 |
| 3,729,335 | 4/1973 | Domrachev | 427/237 |

OTHER PUBLICATIONS

Potts et al., *IBM Tech. Dis. Bulletin,* "Laser Induced Evaporation," vol. 8, No. 2, (7-1965) p. 285.

*Primary Examiner*—Michael F. Esposito
*Attorney, Agent, or Firm*—Hill, Gross, Simpson, Van Santen, Steadman, Chiara & Simpson

[57] ABSTRACT

A band-shaped metal layer useful as a resistance layer and/or a contact layer is pyrolytically deposited onto a cylindrical substrate by surrounding the surface of the substrate with a mixture of a thermally decomposable metal compound and a carrier therefor and substantially simultaneously heating only precise surface areas of the substrate, as by a laser beam, to a temperature slightly above the thermal decomposition temperature of the metal compound and moving the substrate in a rotational and/or axial manner so that a band-shaped metal layer forms only at the heated surface areas of the substrate.

1 Claim, 2 Drawing Figures

PYROLYTIC PROCESS FOR PRODUCING A BAND-SHAPED METAL LAYER ON A SUBSTRATE

CROSS-REFERENCE TO RELATED APPLICATIONS

This is a continuation-in-part application of our U.S. Ser. No. 429,100, filed Dec. 28, 1973 now abandoned, which is incorporated herein by reference. Attention is also directed to our Austrian patent application No. A 9943/73, laid open for public inspection on April 15, 1975 now U.S. Pat. No. 327,326.

BACKGROUND OF THE INVENTION

1. Field of the Invention

The invention relates to band-shaped electrical layer resistance elements and the like and somewhat more specifically to a method of producing such elements.

2. Prior Art

Layer-type resistance elements having resistance layers composed of a metal or a metal alloy exhibit various advantages over the somewhat more conventional carbon layer resistance elements. For example, metal layer resistance elements exhibit a better long-term stability and have a smaller temperature coefficient.

Preferred methods of producing such metal layer resistance elements were based on metal vapor deposition or metal particle dusting of a substrate under high vacuum conditions. In addition, methods are known wherein aqueous or non-aqueous solutions are utilized to produce such metal layer resistance elements. The prior art processes involving the use of vacuum are very expensive because of the substantial amount of equipment which is required to practice such processes. On the other hand, the prior art processes involving deposition or precipitation from metal-containing solutions fail to provide sufficient dispersion and layer thickness control so that accurately reproducible results are very difficult to obtain.

It has heretofore been suggested to form metal layer resistance elements of a desired composition from a mixture of thermally decomposable heavy metal compounds such as, for example, carbonyls, acetylacetones, cyclopentadienes, alkyls, etc. by thermal or pyrolytic decomposition of such organo metallic compounds so that the metal is deposited in a select pattern on a substrate. In comparison to deposition from a liquid, deposition from a gas has the advantage that by suitable selection of a decomposition temperature, the composition of the deposited layer can be precisely controlled by the composition of the gas. In contrast, deposition from a liquid yields a layer having a composition dependent not only on the concentration ratios of material in the liquid but also on the different decomposition energies or decomposition potentials, respectively. Deposition from a gas has the further advantage that the deposition rate and thus the layer thickness can be precisely controlled. A similar advantage may be achieved by deposition from a liquid only if the deposition is limited to a locally restricted highly heated substrate area with all of the desired layer compounds thereat or if such deposition includes an intermediate step of drying the liquid to form a film on the substrate and then heating localized areas of such film to the decomposition temperature of the metal compound within the film. In deposition from a gas, select heavy metal compounds are volatilized and transported to the deposition site by a suitable organic or inorganic carrier gas and/or by means of a reduced or sub-atmospheric pressure.

SUMMARY OF THE INVENTION

The invention provides a pyrolytic process for producing a band-shaped metal layer which may function as a resistance layer and/or as a contact layer on a substrate or carrier body.

An embodiment of the invention generally comprises surrounding a surface, such as the exterior or interior surface of a cylindrical carrier member with a fluid mixture of a thermally decomposable metal compound and a carrier therefor, and substantially simultaneously heating only precise surface areas of the carrier member by a laser beam or electron beam to a temperature slightly above the decompositon temperature of the metal compound (up to about 50° C. above the decomposition temperature) and moving the carrier member in a rotational and axial manner so that a band-shaped helical metal layer forms only on the precisely heated surface areas of the carrier member.

In certain embodiments of the invention, after the helical metal layer is formed, another fluid mixture of a thermally decomposable metal compound (which may be the same as that used in producing the helical metal layer or it may be different therefrom) is brought into contact with the carrier member having the helical metal layer thereon, precise surface areas of such carrier member are heated to a temperature substantially above the decomposition temperature of the metal compound (greater than the decomposition temperature by about 50° C.) and only the rotational movement of the carrier member is maintained so that a bandshaped cylindrical metal layer forms on the precisely heated surface areas of the carrier member and defines metal contact areas on the helical metal layer.

After the deposition process is completed, the carrier member with the deposited metal layers thereon may be quickly cooled, as by an air jet, so as to crack or otherwise sever the carrier member along the path of the deposited metal layers and separate portions of the helical metal layer with spaced metal contact areas thereon into individual resistance elements having contacts at opposite ends thereof.

DESCRIPTION OF THE PREFERRED EMBODIMENTS

Figure 1:
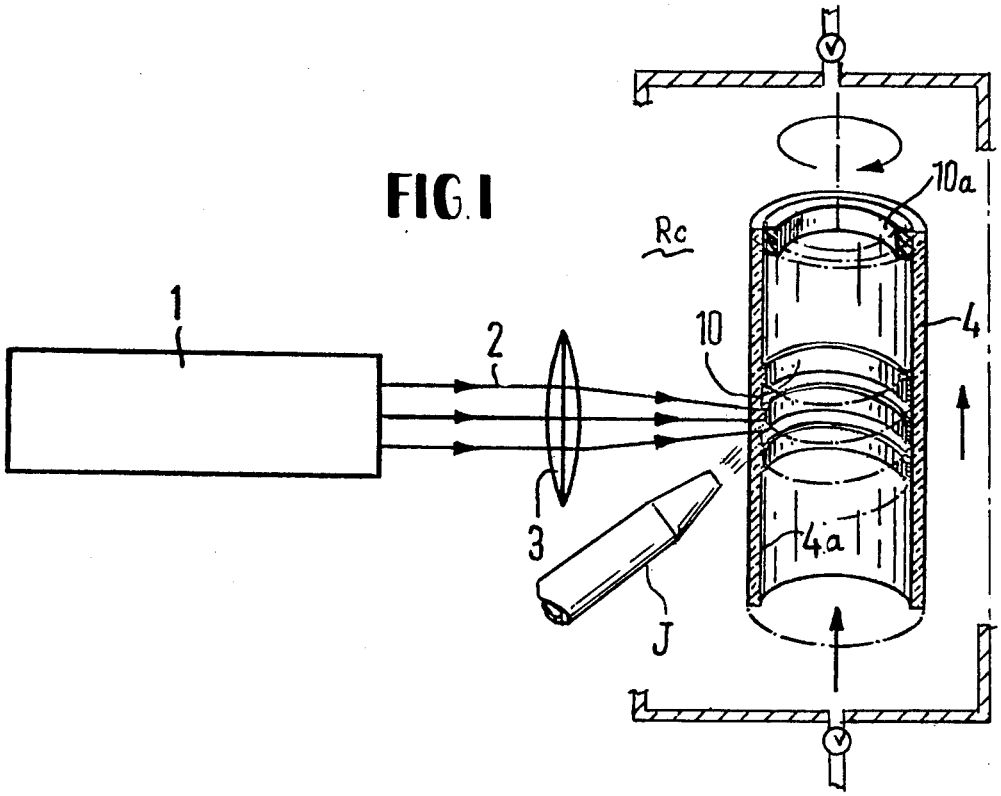
FIG. 1 is a somewhat schematic illustration of an embodiment of the invention.

The invention provides a method of pyrolytically producing band-shaped layer-type resistive elements and like structures.

By practicing the principles of the invention, one may inprove the properties of the resistive elements by incorporating into the metal layer thereof a controlled amount of up to about 20% of non-metallic foreign atoms. The characteristics of such non-metallic atom-containing layers in terms of moisture behavior, long term stability, mechanical behavior, transfer or contact resistance, abrasion resistance (which is of particular importance in resistive elements having adjustable resistance values), are improved.

The incorporation of such non-metallic foreign atoms into metallic layers produced in accordance with the principles of the invention may occur as follows:

a. Selecting a thermally decomposable heavy metal compound for use in the deposition process, which during the thermal decomposition releases or provides a desired foreign atom so that the formed metal layer includes foreign atoms therein. For example, oxygen atoms may be incorporated in, for example, a nickel layer by using nickel acetylacetone or the like.
b. Adding a thermally decomposable compound which contains the desired foreign atoms therein to the deposition fluid (i.e. gas or liquid). For example, when it is desired to incorporate hydrogen atoms within a metal layer, a boron hydride may be added to the deposition gas or solution.
c. Selecting a carrier gas or solution which is thermally decomposable and yields a desired foreign atom upon decomposition. For example, when it is desired to incorporate nitrogen atoms or carbon atoms within the metal layer, ammonia (a carrier gas) or a liquid hydrocarbon (a solvent, such as hexane) may be admixed with the heavy metal compound.

In accordance with the principles of the invention, the process thereof can be carried out in various ways. In one embodiment, the carrier members or substrates (which are preferably cylindrical bodies), which are to be provided with the band-shaped metal layers thereon, may be arranged individually or in parallel or series groups for select movement (i.e. rotational and/or axial) in an enclosed reaction chamber, a stream of a metal deposition fluid (i.e. a gas or solution containing a thermally decomposable heavy metal compound therein) may be brought into contact with the outer surface of such substrates while the substrates are selectively moved and precise outer surface areas thereof are heated to at least the decomposition temperature of a thermally decomposable metal compound (generally about 200° to 400° C.) by a laser or an electron beam. The heavy metal compound pyrolytically decomposes at such heated surface areas and the metal portion thereof is deposited at such localized areas in the form of a band-shaped helical or cylindrical layer, depending upon the movement of the carrier member.

In another embodiment of the invention, select inner surfaces of the substrates (which in such embodiments comprise hollow cylindrical bodies or tubes) may be provided with the band-shaped metal layer by passing a stream of a metal deposition fluid through the interior of such a substrate and heating localized inner surface areas thereof with a laser beam while selectively moving the substrate.

The metal deposition fluid may comprise a gas or a solution which contains therein a thermally decomposable heavy metal compound, such as metal carbonyls, metal acetoacetonates, metal cyclopentadienes, metal alkyls, etc. In instances where a metal deposition solution is used, it may be in the form of a continuously moving stream or a static bath.

Of course, a plurality of separate resistance elements may be formed on a carrier member and may be utilized as unseparated elements on such substrate or may be severed into individual elements.

The deposited layer thickness is readily controlled by the concentration ratio of the metal compounds within the metal deposition fluid and/or by control of the time period during which a select area of the carrier body is heated to the decomposition temperature, i.e. by controlling the relative speed of the laser focal spot as it moves on the surface of the carrier body. By proper control, a relatively uniform and thin band-shaped helical metal layer is readily attained on an outer or inner surface of a carrier body.

In a further embodiment of the invention, a solderable contact may be provided at spaced-apart points or locations of the earlier produced band-shaped helical metal layer. Such solderable contacts are produced by maintaining the rotational movement of the carrier body, after the deposition of the helical metal layer is completed, while discontinuing the axial movement thereof and contacting such carrier body with a stream of a metal depositing fluid (which may be the same or different from that used to form the helical metal layer) and heating precise localized areas of the carrier member to a temperature substantially above the decomposition temperature of the pyrolytically decomposable organometallic compound with such fluid (i.e., about 50° C. or more above the actual decomposition temperature of a given organometallic compound) so that a relatively thick band-shaped cylindrical metal layer is formed on the rotation carrier member and on the helical metal layer. By rapidly cooling the resultant structure, the carrier member cracks along the path of the recently deposited cylindrical metal layer and individual resistive elements having solderable contacts at their terminal points are attained. These contacts, which are relatively thick, may be soldered to suitable leads of electrical circuits or the like as desired.

The carrier body or substrate is preferably composed of a dielectric material selected from the group comprised of ceramic, glass, quartz, a polyamide resin, an epoxy resin, a polyfluorohydrocarbon resin, or a silicone resin and is cylindrically shaped. The carrier body may be in the form of a solid cylindrical rod or in the form of a hollow cylindrical tube. Most preferably, the carrier body, whether solid or hollow, is composed of a ceramic or a glass.

In embodiments of the invention where a ceramic and/or glass carrier body is to be coated with a metal layer (band-shaped) on the outer surface thereof, the wavelength of the laser light used to heat select areas of such a surface may be chosen so that the energy absorption occurs in the substrate and the entire focal spot or area on the substrate is coated with a metal layer. Application of a metal layer to the outer surface of a carrier body may also occur with an electron beam.

In instances where one desires to form band-shaped metal layers on the inner surface of a carrier body, hollow glass tubes are preferably utilized as the carrier body. In such embodiments of the invention, a laser beam is selected which has a wavelength which is only slightly absorbed in the glass itself, i.e., a wavelength which substantially penetrates at least the thickness of a wall of the hollow glass tube. Metal deposition occurs only in the region of an already existing or forming metal layer or area since it is only at such area that sufficient energy absorption takes place to raise the temperature of that area to the deposition or decomposition temperature. The start of such a metal deposition process may include a brief increase in the beam energy.

In instances where one desires a higher rate of metal deposition, two opposite points of an inner wall of a carrier member may be locally heated so that a double helix-shaped metal layer is deposited. In this variation of the invention, the energy focusing characteristics of the glass tube (carrier body) may be utilized for improved deposition.

In another variation of the above embodiment of the invention, a metal spike or reflector may be positioned within a hollow cylindrical glass tube to reflect the irradiated beam against the inner wall of such carrier member. This arrangement provides an improved energy yield and an increased rate of metal deposition.

With the process of the invention, one may, in a single step, produce contact layers (which are relatively thick) and sever the serially interconnected resistive elements into individual components. The metal deposition fluid used to produce the contacts is brought into contact with the carrier member having the helical metal layer thereon during the severing process. The heat energy generated by the laser beam or electron beam decomposes the metal depositing fluid (i.e. a gas or liquid containing a thermally decomposable organometallic compound) and a metal layer is deposited at the heated areas of the carrier surface. The so-deposited metal layer defines the separation lines of the carrier member. In this manner, the location of the separation lines and of the contact layers necessarily coincide and render the invention useful in readily achieving good alignment of the contact layers and the separation lines. Subsequently, the heated portions of the carrier body (now having a relatively thin helical metal layer and a relatively thick cylindrical metal layer thereon) is rapidly cooled, as by a jet of cold air impinged against such heated areas or by dripping or otherwise contacting such heated areas with a cooled liquid, for example, water, so that a clean fissure or separation occurs exactly under the heated and rapidly cooled line.

Referring now to the drawings, FIG. 1 illustrates an embodiment of the invention wherein a laser means 1 emits a laser beam 2 through a focusing lens 3 so as to heat a precise localized surface area on the inner wall 4*a* of a hollow tubular carrier body 4, which preferably may have a length of several meters. The carrier body 4 is mounted for rotational movement about the vertical axis thereof as shown by the curved arrow and for axial movement along the vertical axis as shown by the straight arrow and positioned within a suitably enclosed reaction chamber $R_c$. A stream of metal depositing fluid, such as a gas containing, for example, nickel carbonyl therein, is directed through the interior of carrier body 4 so that a helical band-shaped metal layer 10 forms on the inner surface 4*a* of the carrier body 4.

Figure 2:
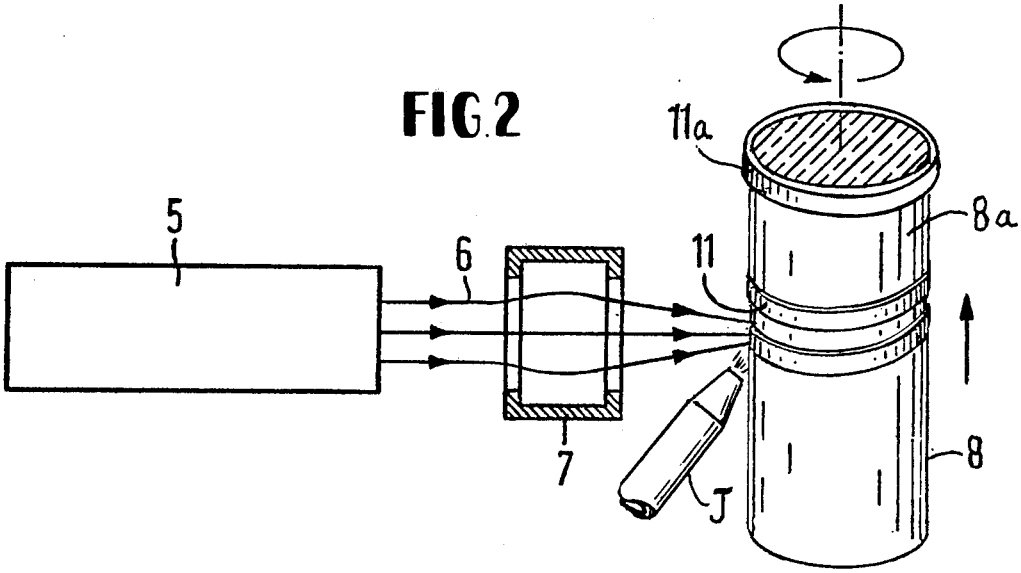
FIG. 2 is a somewhat similar illustration of another embodiment of the invention.

In the embodiment of the invention illustrated at FIG. 2, electron beam generator 5 is shown producing an electron beam 6 which is focused by a lens 7 onto a precise area of an outer surface 8*a* of a solid rod-shaped carrier body 8. The carrier body 8 may also be mounted within a suitable enclosed reaction chamber (not shown) so as to be selectively rotatable about the longitudinal axis thereof and/or axially movable along such axis. A stream of a metal depositing fluid, such as a liquid containing, for example, nickel carbonyl therein, is directed past the outer surface of the carrier body 8 so that a cylindrical band-shaped metal layer 11 forms on the outer surface 8*a* of the carrier (in the illustration the body 1 is only rotated about its vertical axis without axial movement so that a cylindrical metal layer is formed).

A jet J may be positioned in the vicinity of the deposited metal layers 10 or 11, respectively, so as to controllably direct cold air or the like against the heated areas of the substrate at a desired time, i.e. during the severing operation.

Contact rings 10*a* (FIG. 1) and 11*a* (FIG. 2) may be provided at the opposite ends of the carrier body.

In producing the helical band-shaped metal layers, it is preferable to utilize deposition temperatures only slightly above the decomposition temperature of the organometallic compound used to produce such metal layer (i.e., ranging up to about 50° C. or so above the actual decomposition temperature of a particular organometallic compound). In this manner, relatively thin metal layers are formed. On the other hand, in producing the cylindrical band-shaped metal layers, it is preferable to utilize a decomposition temperature substantially above the decomposition temperature of the organometallic compound used to produce such cylindrical metal layers (i.e., ranging from a minimum of about 50° C. and higher above the actual decomposition temperature of a particular organometallic compound). In this manner, relatively thick layers are formed. The nature of the fluid containing the organometallic compound also influences the width and thickness of the deposited metal layer. Generally, liquids or solutions containing an organometallic compound tend to yield wider and thicker metal compounds in relation to a gas containing the same organometallic compound.

The selection of a particular laser beam wavelength is dependent upon whether one desires to form a metal layer, such as 10 or 11, on the inner wall of a tubular carrier body 4, for example, composed of glass or on the outer body of a rod-shaped carrier member, for example, composed of a ceramic material.

In the embodiment shown in FIG. 1, a laser means may be provided which issues a beam of a wavelength that is only slightly absorbed in the material forming the carrier body, i.e., glass. For example, a YAG-laser with a wavelength of 1.06 microns is quite suitable for use in such embodiments. In the embodiment shown in FIG. 2 wherein the carrier body is, for example, composed of a ceramic material, one may employ a laser, instead of an electron beam generator, such as, for example, a $CO_2$ laser having a wavelength of 10.6 microns.

The temperature of an energy focal spot on a carrier body depends on the decomposition temperature of the organometallic compound being used to produce a resistance or contact layer. Examples of some compounds and temperatures of the focal spots useful to produce helical resistance layers or cylindrical contact rings are set forth below:

| Starting Material | State | Focal Spot Temperature: For Resistance Layer | Focal Spot Temperature: For Contact Rings |
|---|---|---|---|
| Metal carbonyl | Gaseous | 200°–250° C. | above 250° C. |
| | In solution | 200°–250° C. | above 250° C. |
| Acetylacetonates | Gaseous | 300°–350° C. | above 350° C. |
| | In solution | 300°–350° C. | above 350° C. |

In embodiments where contact rings are being produced, the axial movement of the carrier body is stopped while the rotational movement thereof continues. Thereafter, a mixture of a gaseous organometallic compound and a carrier gas or, preferably, a liquefied organometallic compound and a solvent therefor are fed to the carrier body and the temperature of the energy focal spot is increased. In this manner, the heated spot on the carrier body defines a heated ring about the body on which a relatively thick layer of solderable metal is deposited and forms the contact ring.

In preparing the carrier bodies for subsequent separation into individual resistor elements (after deposition of the helical metal layer and the cylindrical metal layer), the annularly heated and metal coated area of the carrier body is rapidly cooled, for example, by directing a stream of cold air over such area or by dripping water thereon. The resulting thermal stresses cause the formation of an annular crack or the like in the carrier body so that separation readily occurs along this annular crack, which lies approximately below the middle of the contact ring so that after severance, both sides of the solderable metal layer remain.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appendant claims.

We claim as our invention:

1. A pyrolytic method for the production on a cylindrical carrier member of resistors having a band-shaped resistance layer and a contact area at the ends thereof, comprising:

surrounding a surface of the carrier member to be coated with a first fluid mixture of at least one thermally decomposable metal compound and a carrier therefor;

substantially simultaneously heating only precise surface areas of said carrier member by a laser beam or an electron beam to a temperature slightly above the decomposition temperature of said metal compound, rotating said carrier member about a vertical axis thereof and axially moving said carrier member along the vertical axis thereof whereby a band-shaped helical metal deposit forms only on said precise surface areas of the carrier member;

removing said first fluid mixture from about the carrier member and stopping said axial movement of the carrier member while maintaining the rotational movement thereof;

surrounding the surface of such carrier member with a second fluid mixture of at least one thermally decomposable metal compound and a carrier therefor;

heating only precise surface areas of the carrier member by a laser beam or an electron beam to a temperature substantially above the decomposition temperature of the metal compound in the second fluid mixture whereby a band-shaped cylindrical metal deposit forms only on said precise surface areas of the carrier member so as to define spaced metal contact areas on said helical metal deposit; and relatively quickly cooling the resultant carrier member with metal deposits thereon so as to form discontinuities in the carrier member for separating the helical metal deposits with the spaced contact areas thereon into individual resistors having contacts at opposite ends thereof.

* * * * *